US006227935B1

(12) United States Patent
Smith et al.

(10) Patent No.: US 6,227,935 B1
(45) Date of Patent: May 8, 2001

(54) IMAGE INVERTIBLE OBJECTS AND METHODS OF MAKING THE SAME

(75) Inventors: Cheri Smith, Waltham; Andrew J. Paraskevas, Norton, both of MA (US)

(73) Assignee: Magic Eye, Inc., Provincetown, MA (US)

( * ) Notice: Subject to any disclaimer, the term of this patent is extended or adjusted under 35 U.S.C. 154(b) by 0 days.

(21) Appl. No.: 09/071,665

(22) Filed: May 1, 1998

Related U.S. Application Data

(60) Provisional application No. 60/045,744, filed on May 6, 1997.

(51) Int. Cl.[7] ..... A63H 33/00; G09F 1/00; A63G 31/00

(52) U.S. Cl. ..... 446/488; 472/72; 4/124

(58) Field of Search ..... 446/487, 491, 446/219, 151, 149, 57, 488; 472/70, 72, 61, 63; 40/124.09, 429, 539; 428/3, 13

(56) References Cited

U.S. PATENT DOCUMENTS

| | | | | |
|---|---|---|---|---|
| 2,154,087 | * | 4/1939 | Fawcett | 40/124.09 |
| 2,334,750 | * | 11/1943 | Cerracchio | 40/540 |
| 3,268,238 | * | 8/1966 | Finkel | 40/427 X |
| 3,538,632 | * | 11/1970 | Anderson | 40/124.09 |
| 4,531,319 | * | 7/1985 | Saxton | 40/539 X |
| 4,778,392 | * | 10/1988 | Mitchell | 446/488 X |
| 4,854,591 | | 8/1989 | Setteducati . | |
| 5,201,548 | * | 4/1993 | Lang et al. | 40/124.1 X |
| 5,682,999 | * | 11/1997 | Larson | 40/539 |
| 5,763,102 | * | 6/1998 | Yau | 428/542.2 X |
| 5,782,698 | * | 7/1998 | Keller | 40/124.09 X |

FOREIGN PATENT DOCUMENTS

| | | |
|---|---|---|
| 0371705 | 6/1990 | (EP) . |
| 1384877 | 4/1965 | (FR) . |

OTHER PUBLICATIONS

Gathering for Gardner II "Hyper House" and Missing Wheel by Jerry Andrus© 1994.

The Exploratorium Science Snackbook Series, "The Cheshire Cat & Other Eye–Popping Experiments on How We See the World," Paul Doherty, Don Rathien, Exploratorium Teacher Insitute.

* cited by examiner

*Primary Examiner*—D. Neal Muir
(74) *Attorney, Agent, or Firm*—Wolf, Greenfield & Sacks, P.C.

(57) ABSTRACT

A three-dimensional object and method of use is described, such object appearing inverted when viewed by a single eye of a human subject at a selected angle, the three-dimensional object comprising at least one sheet having at least two selected edges, a contoured edge and a surface on which a two-dimensional pattern is formed, at least two of the selected edges of the sheet being attached to each other at an angle of greater than about 25 degrees such that a composite three-dimensional object having at least three interior surfaces and a contoured edge is formed therefrom. The three-dimensional object can further include indicium extending along a portion or all of intersection and fold lines that result when such objects are formed. The interior surfaces can further include patterns, indicia, features and protruding edges.

23 Claims, 12 Drawing Sheets

IMAGE INVERTIBLE OBJECTS AND METHODS OF MAKING THE SAME

RELATED APPLICATIONS

This application claims priority under 35 U.S.C.§ 119(e) to commonly-owned, co-pending U.S. provisional patent application serial no. 60/045,744 entitled "IMAGE INVERTIBLE OBJECTS AND METHODS OF MAKING THE SAME", filed May 6, 1997 by Cheri Smith, et al., which is incorporated herein by reference in its entirety.

BACKGROUND OF THE INVENTION

1. Field of the Invention

The present invention relates generally to image invertible objects and methods of making the same.

2. Related Art

Optical illusions rely on the ability of the brain to trick the eyes into recognizing unfamiliar shapes or patterns as something with which they are familiar. When a pattern is perceived by our eyes, the brain will first attempt to recognize it as something familiar by supplying or substituting any information missing from the pattern which would make it familiar, before trying to resolve unfamiliar images. For example, in "The Cheshire Cat & Other Eye-Popping Experiments on How We see the World," by Paul Doherty, Don Rathjen and the Exploratorium Teacher Institute, an optical illusion is described that takes advantage of this pattern-recognition ability, as well as another phenomena—that the eye-brain system is used to seeing nearby objects whiz by, whereas distant objects appear to follow at a slower pace. In the "Far Out Corners" experiment, a stationary cluster of three-sided partial cubes is illuminated from below, and made to appear is if they are moving when a viewer walks past the arrangement. Because solid cubes are objects with which our brains are familiar, the brain supplies the rest of the cube shape, even thought the partial cubes only have three sides. Therefore, because the brain incorrectly perceives the inside corner of the partial cube as the outside corner of a solid cube, the brain perceives the farthest corner of the partial cube as being the closest. In order to maintain this misconception, the brain perceives a rapid rotation of the cube as the viewer moves past the object.

Other types of optical illusion are described in "Gathering for Gardner II", by Jerry Andrus. The illusion of a "convex hour" is described, in which a two-dimensional outline of a house is created on paper, then cut out, folded and taped together to form a portion of a three-dimensional house. When viewed with one eye, the house appears inverted, thus, the term "convex house."

In another illusion, a two-dimensional image of the side of the bus is created on paper. The bus has two wheels located on its side. A two-dimensional image of a third wheel is placed away from the image of the bus. A separate two-dimensional image of the truck top is positioned along the perimeter of a portion of the bus, at approximately an angle of 45 degrees. Viewed at an angle, the tire located away from the perimeter of the bus is made to appear as if it is on the surface of the bus, overlapping one of the tires that is drawn thereon.

There are therefore provided three-dimensional image invertible objects having a high contrast, multicolored, and patterned surface that appear inverted when viewed with one eye, as well as methods of making the same.

SUMMARY OF THE INVENTION

In accordance with the invention, there is provided a three-dimensional object having a three-dimensional image when viewed by two eyes of a human subject, the three-dimensional image of the object appearing inverted when viewed by a single eye of the subject at a selected angle, the object comprising at least one sheet having at least two selected edges, a contoured outer edge and a surface on which a two-dimensional pattern is formed, at least two of the selected edges of the sheet being attached to each other at an angle of greater than about 25 degrees such that a composite three-dimensional object having at least three interior surfaces and a contoured edge is formed therefrom. The three-dimensional object can further include indicium extending along a portion or all of intersection and fold lines that result when such objects are formed. The interior surfaces can further include patterns, indicia, features and protruding edges. A plurality of the three-dimensional objects can also be connected together in any manner, such as, for example, in series, as a diorama, or in a shadow box, etc.

Further in accordance with the invention, there is provided a method of creating an inverted image of a three-dimensional object, the method comprising: providing at least one sheet having a first surface, a contoured edge, and at least two selected edges, forming a patterned two-dimensional image on the first surface, forming a first composite three-dimensional object from the at least one sheet by attaching at least two of the selected edges at an angle of greater than about 25 degrees such that the composite comprises at least three interior surfaces and a contoured outer edge, and holding and moving the composite three-dimensional object in a line of sight of a single eye of a human subject at an angular disposition such that the three-dimensional image of the object is aligned in a perspective or isometric view along the line of sight of the single eye.

The method further includes imparting movement to the three-dimensional objects in order to create the appearance of animation objects, especially when such three-dimensional objects are connected.

The foregoing and other objects, features, aspects and advantages of the invention will become apparent from the following detailed description of the present invention when taken in conjunction with the accompanying drawings. For purposes of clarity, not every component is labeled in every figure.

BRIEF DESCRIPTION OF THE DRAWINGS

Various embodiments are described herein with reference to the drawings, wherein.

DETAILED DESCRIPTION OF THE PREFERRED EMBODIMENTS

The present invention provides three-dimensional image invertible objects having contoured outer edges and high contrast surfaces that appear inverted when viewed with one eye, as well as methods of making the same. "Inverted" or "invertible," as used herein, refer to a three-dimensional object in which a far comer can or appears to be foremost in a viewer's line of vision when viewed with one eye. "Inversion," as used herein, refers to the process by which the far comer of a three-dimensional object may be made to appear foremost in a viewer's line of vision when viewed with one eye.

Figure 2:
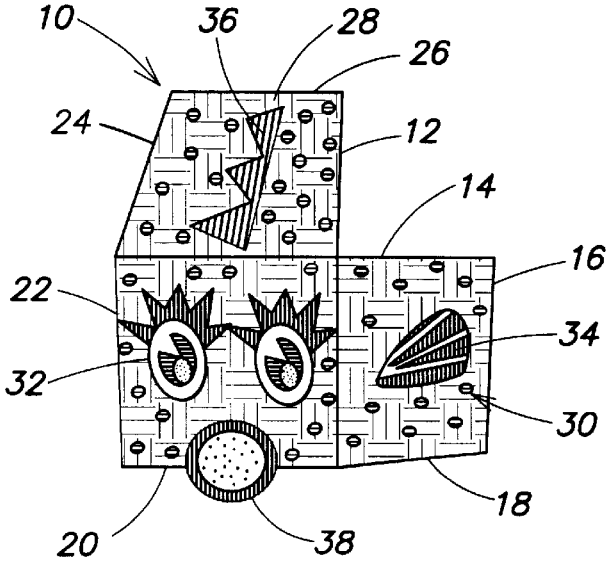
FIG. 2 is an illustration of the object of FIG. 1 in an unassembled configuration.
Figure 4:
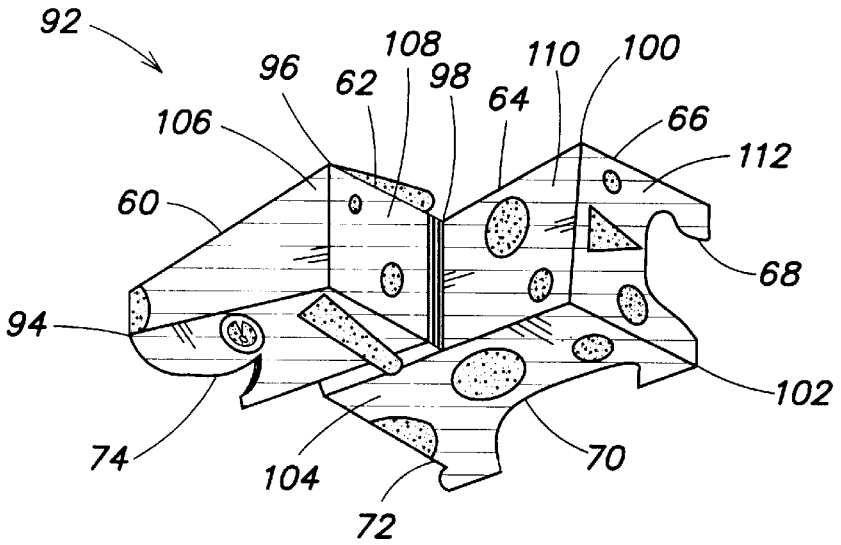
FIG. 4 is a perspective illustration of an image invertible dog in an assembled configuration according to the present invention.

A three-dimensional image invertible object of the present invention includes, in the broadest sense, various inversion enhancing features which may include patterns, indicia, contoured and protruding edges, features formed on the surface of a sheet, features connected to the surface of a sheet, materials applied to the surface of a sheet, or any combination thereof. The sheet preferably includes at least two interior selected edges attached to each other at an angle of at least about 250 to form at least three interior surfaces when in an assembled configuration. In a particularly preferred embodiment, the image invertible objects of the present invention are formed from sheets of foam board or press board. As used herein, "sheet" is meant to define a multitude of materials from which the image invertible objects of the present invention may be formed, including, but not limited to, foam board, cardboard, fabric, plastic, wood, and the like. Although preferred, it is not a requirement of the present invention that the sheets be a rigid or planar material. That is, the objects may be assembled using nonrigid materials such as fabric or felt, which may require the application of a coating, such as, for example, polyurethane, in order to allow the fabric to maintain an assembled shape. In preferred embodiments, the interior surfaces may each be different colors, shades of the same color, or may each be multi-colored. In addition, the interior surfaces may each include a pattern formed thereon such that when assembled, the pattern has a different, or alternatively the same orientation with respect to a reference surface. Various features, including animating features can also be included and can be made to protrude from the edges of the objects so as to impart realism to the object. For example, as illustrated in FIG. 4, the ear of a dog may protrude from one edge of an object shaped like a dog. It is preferred that different colors be used for both the pattern and the features, especially those colors that contrast highly with the color used as the background surface. In preferred embodiments, indicia can extend along any portion or all of the intersection and fold lines that are formed when such objects are in an assembled configuration. Although not necessary, it is preferred that patterns, indicia and features have a color and light reflective intensity that is visually distinct from the color of the interior surfaces;

A flat configuration of a first embodiment of an image invertible object 10 according to the present invention is illustrated in FIG. 2. Object 10 includes selected interior selected edges 12 and 14, outer edges 16, 18, 20, 22, 24, and 26 , and a background surface 28. Background surface 28 may include a pattern 30 and representations of various animating features such as eyes 32, ear 34, hair 36 and mouth 38 extending from outer edge 20. Multiple colors, shades of color and/or combinations thereof, including black and white, may be utilized in order to enhance the contrast of the various elements. For example, the background color may be yellow while the pattern may include black circles or ovals with the color blue therein. In addition, multiple colors may also be utilized for the background surface, pattern and various animating features. For example, object 10 may include blue eyes and a scarlet ear, eyelashes, hair and mouth.

Figure 1:
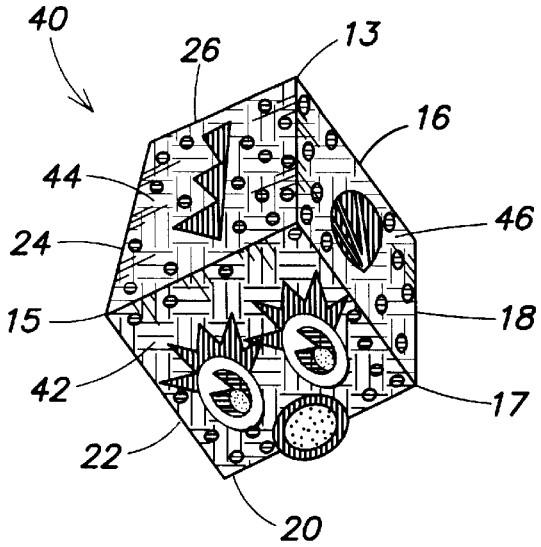
FIG. 1 is a perspective illustration of an image invertible object of the present invention in an assembled configuration.

When assembled, as shown in FIG. 1, interior selected edges 12 and 14 of object 10 are attached at intersection line 13 thereby forming three-dimensional object 40 having a first interior surface 42 with second and third interior surfaces 44 and 46 extending therefrom. Second interior surface 44 extends from first interior surface 42 at fold line 15, while third interior surface 46 extends from first interior surface 42 at fold line 17. Selected outer edges 16, 18, 20, 22, 24, and 26 may further be contoured, for example, to include an angular orientation, and indicia may additionally be provided along each of the lines 13, 15 and 17 in order to enhance the visual contrast between the three interior surfaces. In addition, selected outer edges 16, 18, 20, 22, 24, and 26 may further include animating features such as mouth 38 that protrudes from outer edge 20. First interior surface 42 may be bounded by fold lines 15 and 17 and contoured outer edges 20 and 22. Second interior surface 44 may be bounded by fold line 15, intersection line 13, and countered outer edges 24 and 26. Finally, third interior surface 46 may be bounded by fold line 17, intersection line 13, and contoured outer edges 16 and 18. Interior selected edges 12 and 14 of object 10 may be attached such that second and third interior surfaces 44 and 46 are disposed at an angle of at least about 25 degrees with respect to each other, and disposed at an angle of at least about 60 degrees with respect to first interior surface 42.

Figure 9A:
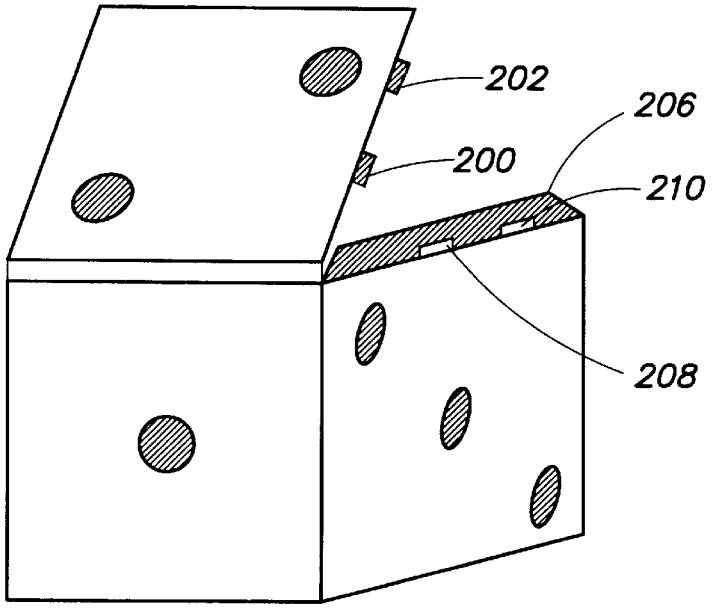
FIG. 9A is an illustration of an image invertible die constructed of foam board, in an unassembled configuration, having male and female tabs for assembling the object.
Figure 9B:
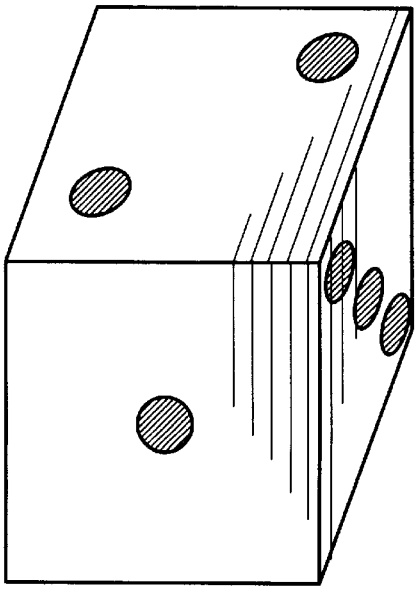
FIG. 9B is an illustration of the image invertible die of FIG. 9A in an assembled configuration.

In the present embodiment, selected outer edges 16, 18, 20, 22, 24, and 26 are all contoured, and selected edges 12 and 14 are attached by using, for example, an adhesive, such as tape, such that second and third interior surfaces 44 and 46 are disposed at an angle of about 45 degrees with respect to each other, and disposed at an angle of about 90 degrees with respect to first interior surface 42. Other methods of attaching the selected edges may be used, including, but not limited to, glue, epoxy, staples, heat, and the like, or any other material or method that will join or fuse the selected sheets together along an intersection line. One preferred method of attaching the selected edges is shown in FIG. 9A, which is via tabs 200, 202 and 206 extending from the selected edges, and tabs inserts 208 and 210 positioned in tab 206 for receiving tabs 200 and 202. FIG. 9B illustrates the image invertible die in an assembled configuration.

In the embodiments described herein, the image invertible objects include both fold lines and intersection lines. It is not required that the objects be formed with fold lines. For example, the image invertible objects may be formed by joining a plurality of separate sheets, resulting in an object including only intersection lines. The image invertible objects may also include a plurality of both fold lines and intersection lines. For example, when formed from a plurality of sheets, each sheet may include a fold lines, resulting in an image invertible object having more than one fold line.

Figure 10:
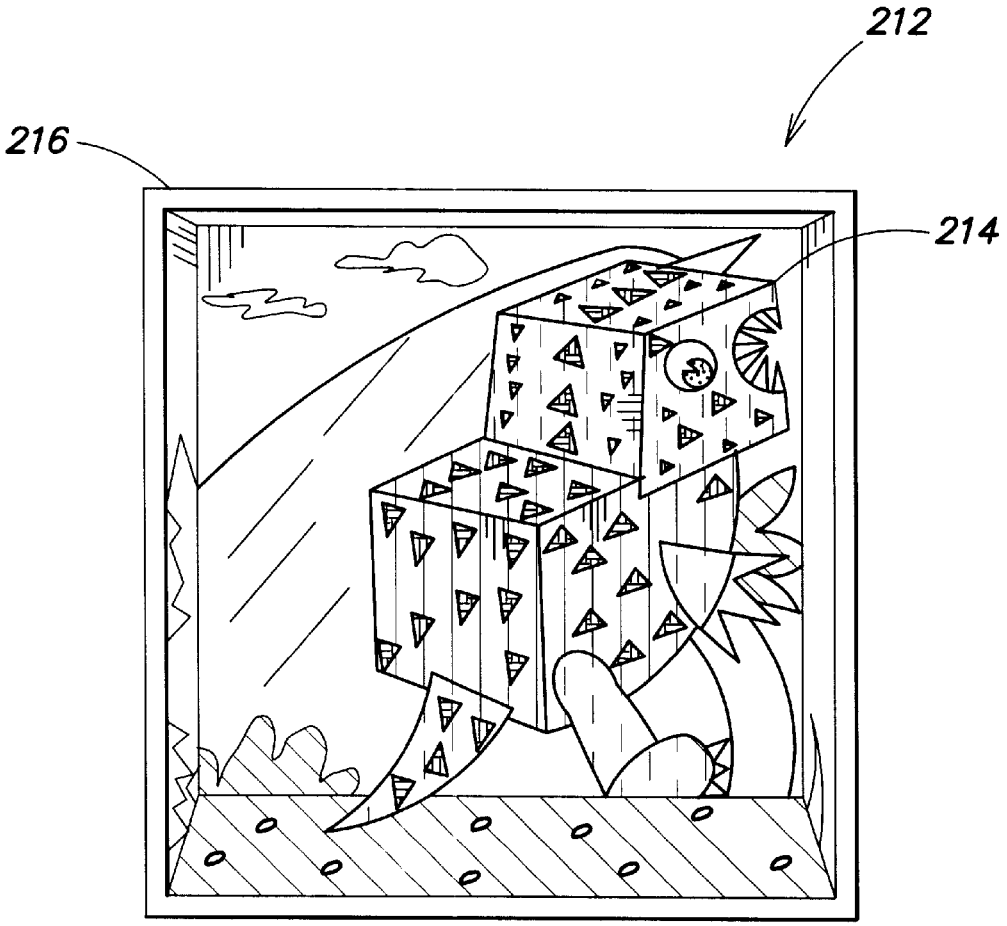
FIG. 10 is an illustration of a combination of image invertible lizard of the present invention enclosed and supported by a box.
Figure 11A:
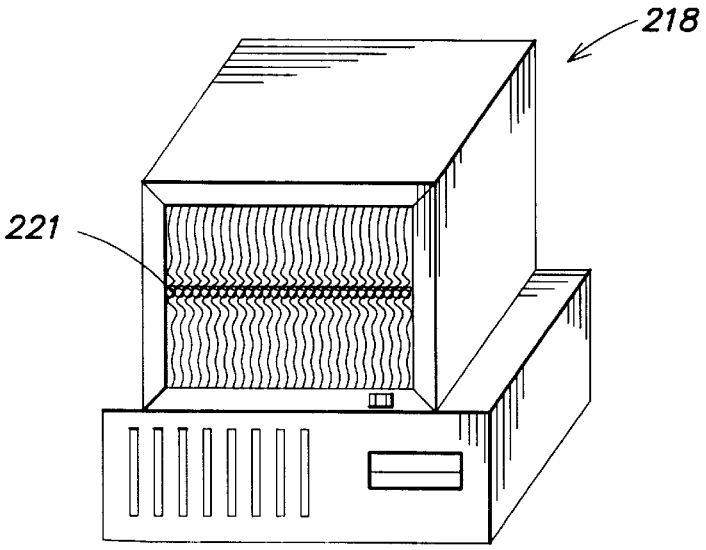
FIG. 11A is an illustration of an assembled image invertible computer of the present invention including a MAGIC-EYE™ stereogram.
Figure 11B:
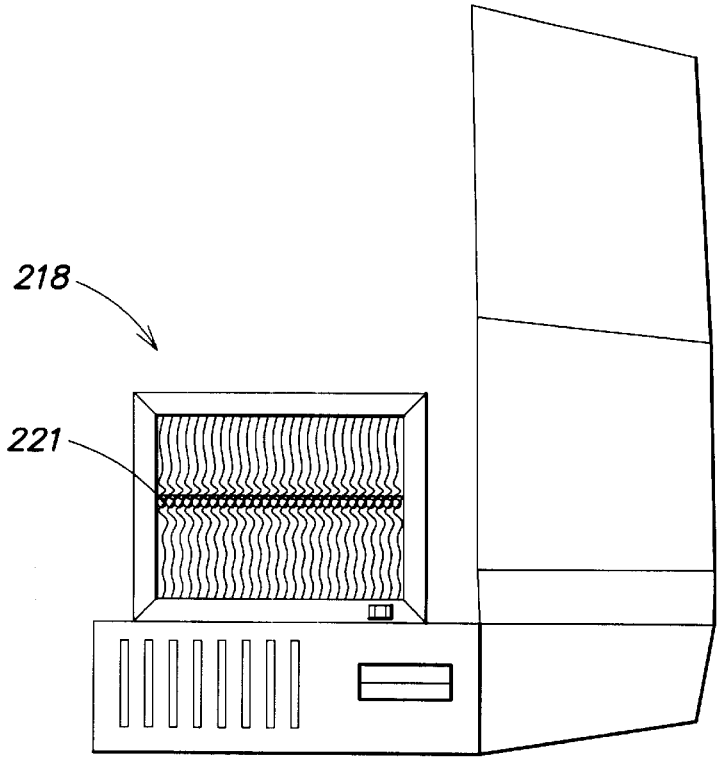
FIG. 11B is an illustration of an unassembled image invertible computer of the present invention including a MAGIC-EYE™ stereogram.
Figure 12A:
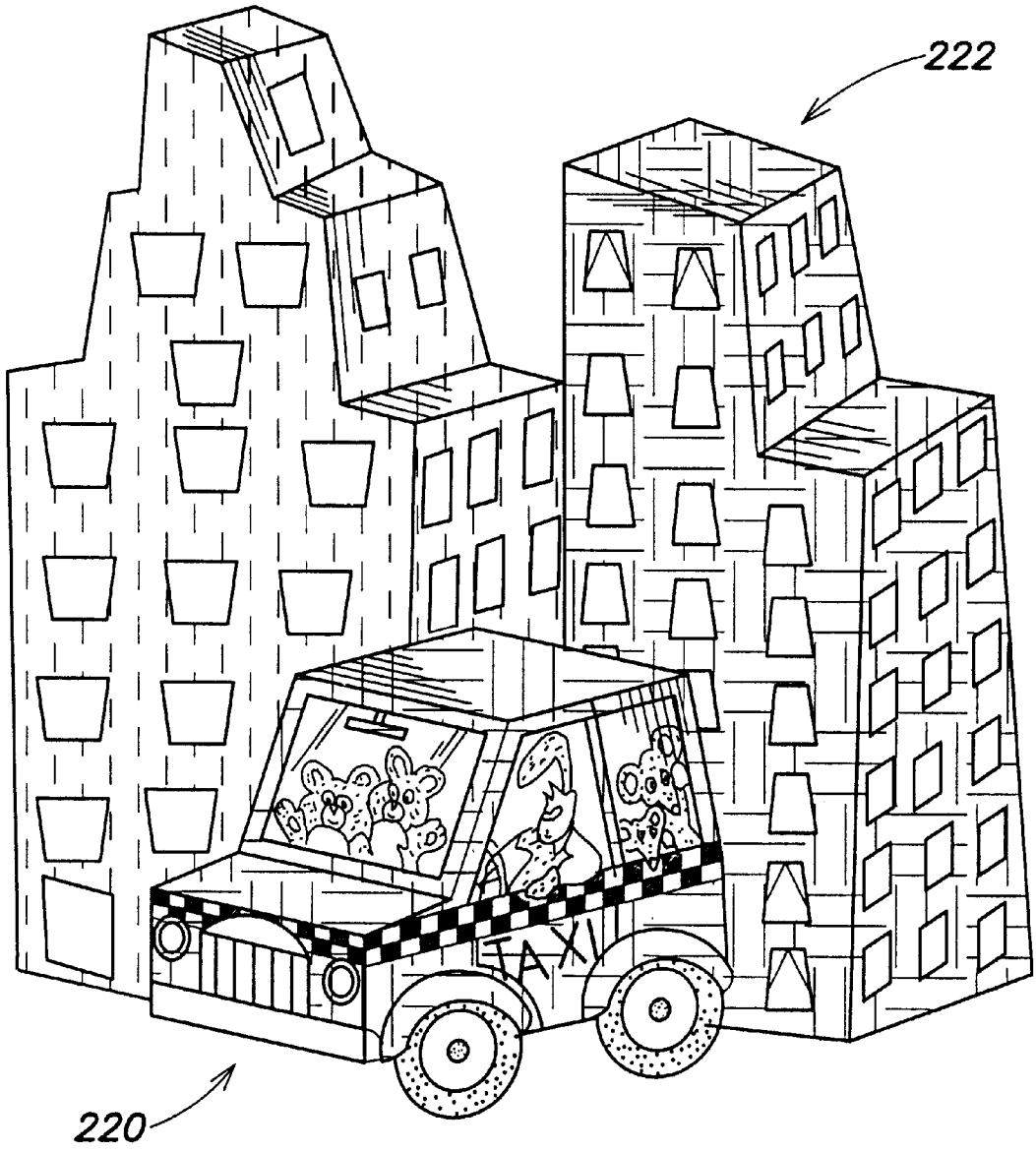
FIG. 12A is an illustration of an assembled image invertible car connected to two assembled buildings.
Figure 12B:
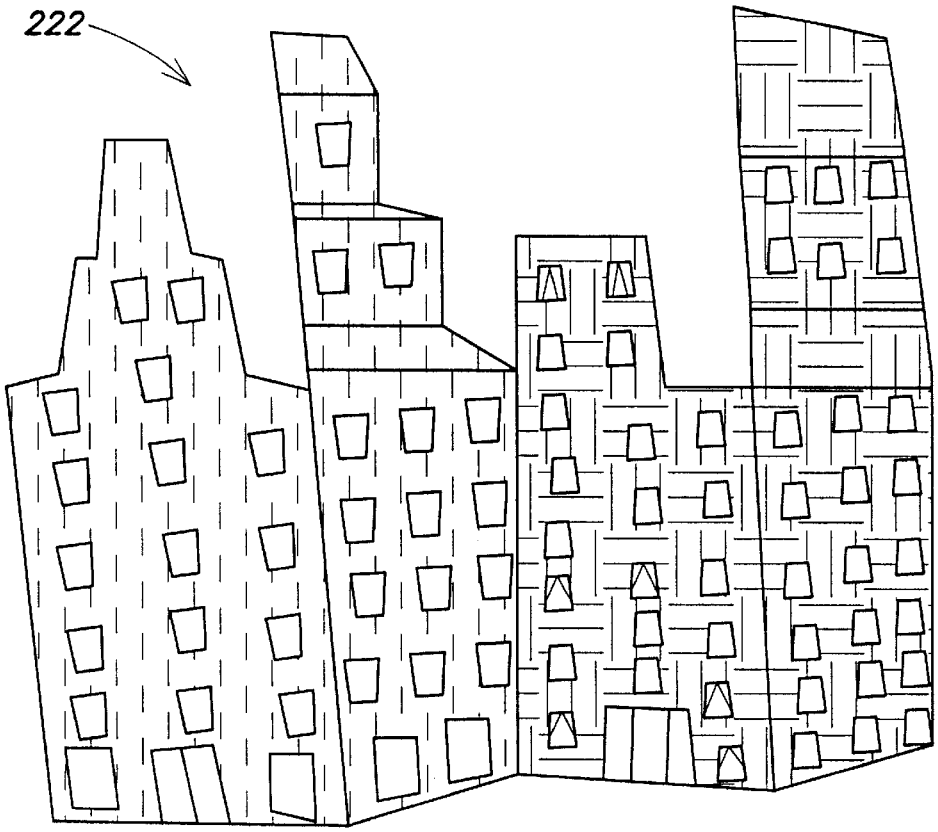
FIGS. 12B and 12C illustrate the unassembled and unconnected image invertible car and two buildings of FIG. 12A.
Figure 12C:
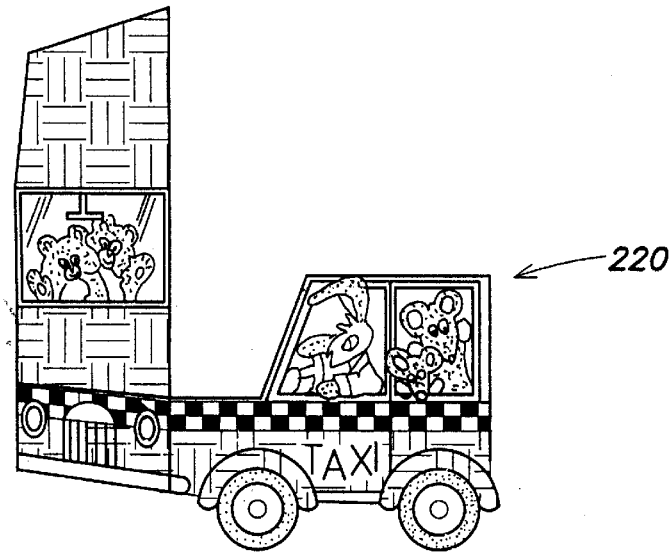

More complex image invertible objects can be provided by increasing the number of selected edges and interior surfaces, or combining at least two image invertible objects. For example, the image invertible objects may be used to represent common objects such as, but not limited to, cars, buildings, televisions, computers, and the like. FIG. 12A illustrates three connected and assembled image invertible objects: car 220, and building 222; the objects are shown in an unassembled configuration in FIGS. 12B and 12C. The image invertible objects may also be assembled and connected as a diorama, or a shadow box, and may further include other optical illusions, such as, for example, MAGIC-EYE™ stereograms or MAGIC-EYE FLOATER™ autostereograms. FIG. 11A illustrates a computer 218 in an assembled configuration, having a MAGIC-EYE™ stereogram 220 on one surface, representing a screen. The computer 218 is shown unassembled in FIG. 11B. FIG. 10 illustrates a shadow box or diorama 212 in which an image invertible lizard 214 is enclosed and supported by a box 216.

Figure 8:
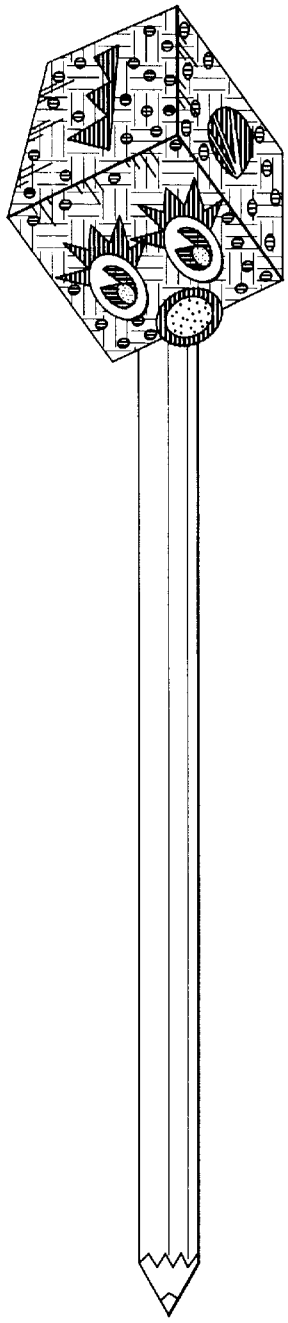
FIG. 8 is an illustration of an image invertible object supported by a pencil.
Figure 13A:
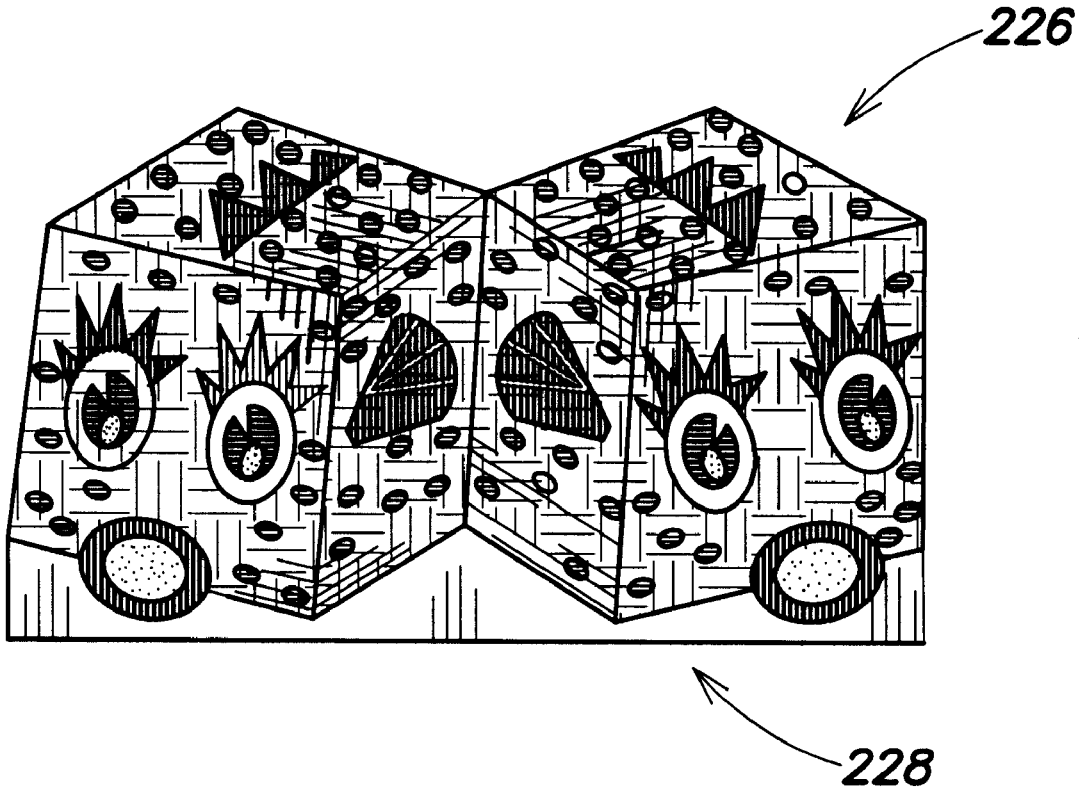
FIG. 13A is an illustration of an assembled image invertible object supported by a base.
Figure 13B:
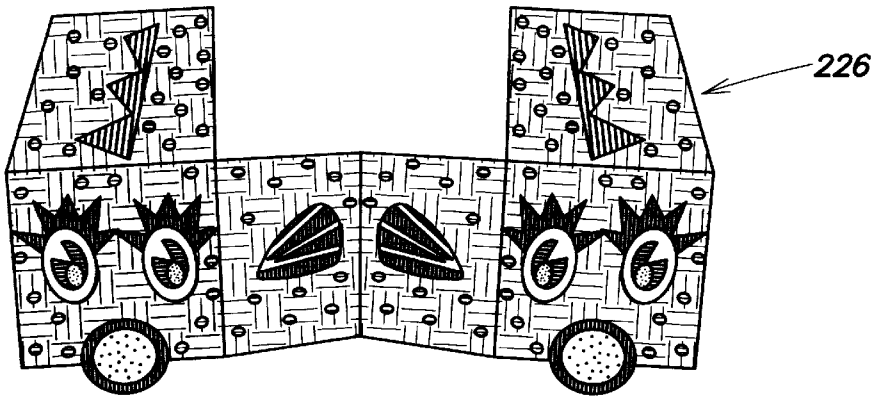
FIGS. 13B and 13C illustrate the unassembled and unconnected image invertible object and base of FIG. 13A.
Figure 13C:
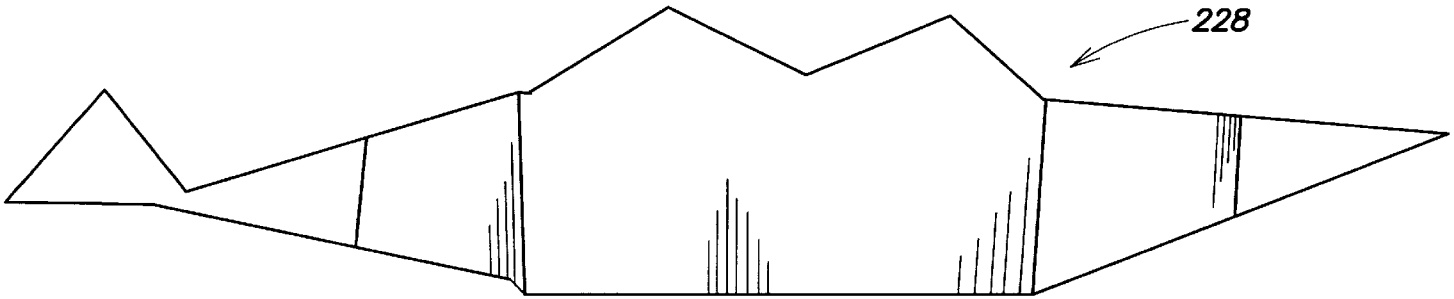

The image invertible objects of the present invention may also include a fastener of some type, which allows the objects to be attached and supported by another object, for example, a pencil, as illustrated in FIG. 8. Such fasteners may include, but are not limited to, tape, double sided tape, glue, clips, staples, gum adhesive, epoxy, and the like. Alternatively, the object of the present invention may be supported by a base. "Base," as used herein, refers to any structure that provides support for the objects of the present invention, including, but not limited to the examples used herein of a pencil, a box, or an integral structure. FIGS. 13A, 13B and 13C illustrate an assembled and unassembled image invertible object 226, supported by an integral base structure 228 extending from the edges of the object. Alternatively, an image invertible object may be enclosed in, for example, a box, as described above with reference to FIG. 10. The function of the box is to provide a base to support the object in a desired orientation and also to provide a desired background.

Figure 5:
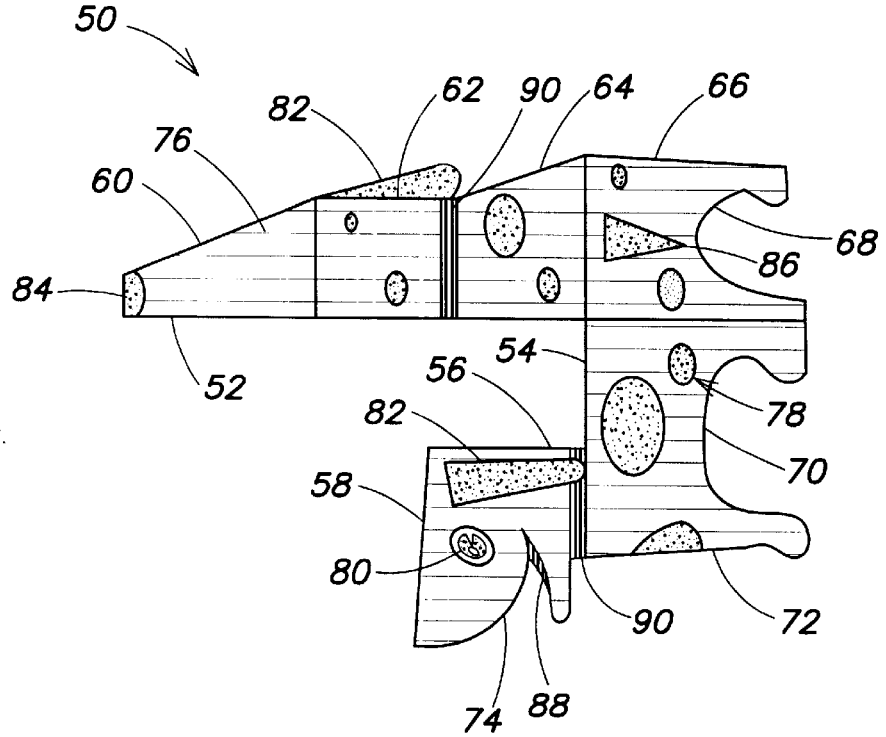
FIG. 5 is an illustration of the image invertible dog illustrated in FIG. 4 in an unassembled configuration.

A second embodiment of an image invertible object 50 is illustrated in a flat configuration in FIG. 5. Object 50 includes selected interior edges 52, 54, 56 and 58, selected outer edges 60, 62, 64, 66, 68, 70, 72, and 74, and background surface 76. Background surface 76 may include a pattern 78 and representations of various animating features of a dog such as eyes 80, ears 82, one of which protrudes from outer edge 62, nose 84, tail 86, as well as tongue 88 and collar 90 superimposed thereon. As previously described, multiple colors, shades of color and/or combinations thereof, including black and white, may be utilized in order to enhance the contrast of the various elements, and multiple colors may also be utilized for the background surface, pattern and various animating features. Thus, object 50 may include a blue background surface on which is superimposed a pattern of white circles or ovals having a black interior, a pink tongue and collar, blue eyes, and black ears and nose.

When assembled, as shown in FIG. 4, interior selected edges 52, 54, 56 and 58 of object 50 are attached at intersection line 94 thereby forming a three-dimensional object 92 in the shape of a dog having a first interior surface 104 with second 106, third 108, fourth 110 and fifth 112 interior surfaces extending therefrom. Second, third and fourth interior surfaces 106, 108, and 110 extend from first interior surface 104 at intersection line 94, while fifth interior surface 112 extends from first interior surface 94 at fold line 102. As previously described, selected outer edges 60, 62, 64, 66, 68, 70, 72, and 74 may further be contoured to include an angular orientation in order to enhance the visual contrast between the three interior surfaces. In addition, or alternatively, indicia may further be provided along intersection line 94 and fold lines 96, 98, 100, and 102, and along decorative collar 90 contiguous with line 98, for visual contrast. Selected outer edges 60, 62, 64, 66, 68, 70, 72, and 74 may further include animating features such as ear 82 that protrudes from outer edge 62. First interior surface 104 may be bounded by intersection line 94, fold line 102, and outer edges 70, 72, and 74. Second interior surface 106 may be bounded by intersection line 94, fold line 96, and outer edge 60. Third interior surface 108 may be bounded by intersection line 94, fold lines 96 and 98 and outer edge 62. Fourth interior surface 110 may be bounded by intersection line 94, fold lines 98 and 100 and outer edge 64. Finally, fifth interior surface 112 may be bounded by fold lines 100 and 102 and outer edges 66 and 68. Interior selected edges 52, 54, 56, and 58 of object 50 may be attached such that second and third interior surfaces 106 and 108, third and fourth interior surfaces 108 and 110, and fourth and fifth interior surfaces 110 and 112 may be disposed at an angle of at least about 25 degrees with respect to each other, and may be disposed at an angle of at least about 60 degrees with respect to first interior surface 104.

In the present embodiment, all outer edges are contoured. Second and third interior surfaces 106 and 108, third and fourth interior surfaces 108 and 110, and fourth and fifth interior surfaces 110 and 112 are disposed at an angle of about 45 degrees with respect to each other, and are disposed at an angle of about 90 degrees with respect to first interior surface 104.

Figure 6:
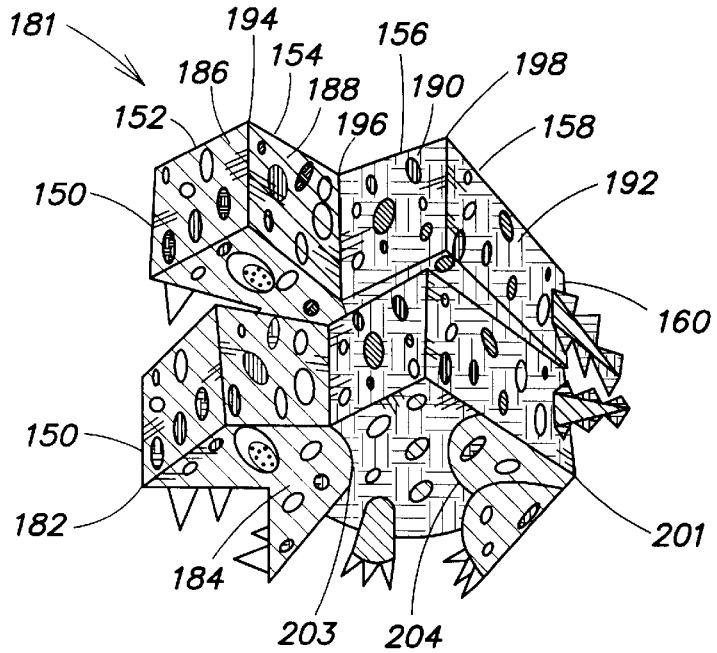
FIG. 6 is a perspective illustration of two connected image invertible lizards in an assembled configuration.
Figure 7:
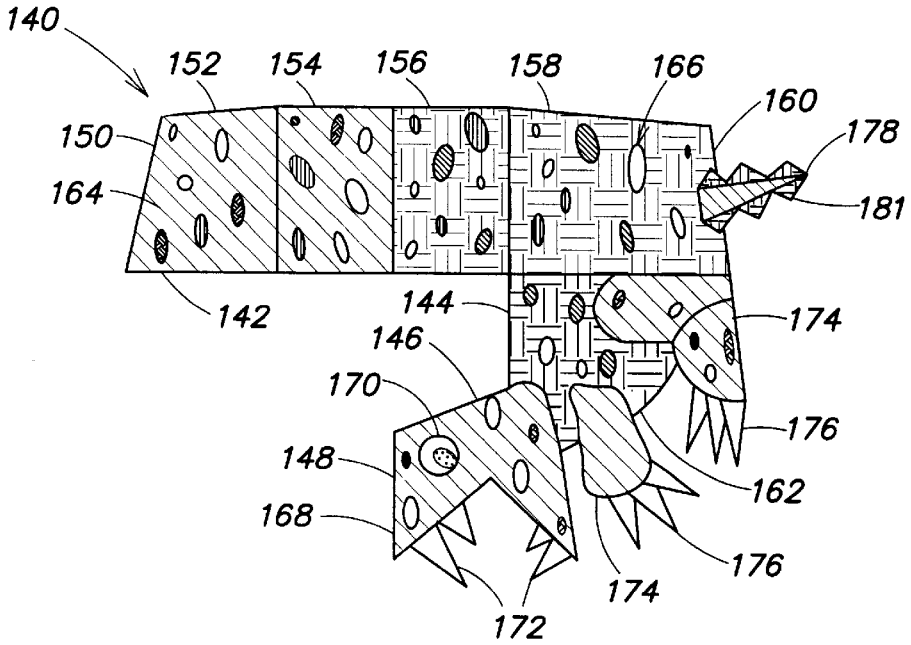
FIG. 7 is an illustration of one of the lizards of FIG. 6 in an unassembled configuration.

In a third embodiment, two image invertible objects are connected as illustrated in FIG. 6. In an individual flat configuration shown in FIG. 7, object 140, a lizard, includes selected interior edges 142, 144, 146 and 148, selected outer edges 150, 152, 154, 156, 158, 160, and 162, and background surface 164. Background surface 164 may include a pattern 166 superimposed thereon. Representations of various animating features of a lizard may also be included such as head 168 having an eye 170 and protruding teeth 172, protruding legs 174 with claws 176, and a tail 178 with serrated edges 180. Again, multiple colors, shades of color and/or combinations thereof, including black and white, may be utilized in order to enhance the contrast of the various elements, and multiple colors may also be utilized for the background surface, pattern and various animating features. Thus, lizard 140 may include a background surface having green and yellow portions with a pattern of circles and ovals colored white, green, yellow or pink thereon, with the legs and head of the lizard colored green.

When assembled, as shown in FIG. 6, interior selected edges 142, 144, 146 and 148 of object 140 are attached at intersection line 182 thereby forming a three-dimensional object 180 in the shape of a lizard having a first interior surface 184 with second 186, third 188, fourth 190 and fifth 192 interior surfaces extending therefrom. Second, third and fourth interior surfaces 186, 188, and 190 extend from first interior surface 184 at intersection line 182, while fifth interior surface 192 extends from first interior surface 184 at fold line 200. Again, selected outer edges 150, 152, 154, 156, 158, 160, and 162 may further be contoured to include an angular orientation in order to enhance the visual contrast between the three interior surfaces. In addition, or alternatively, indicia may further be provided along intersection line 182 and fold lines 194, 196, 198, and 200 for visual contrast. Selected outer edges 150, 152, 154, 156, 158, 160, and 162 may further include protruding animating features such as legs 174 that protrude from outer edge 162. Object 140 may further include indicia delineating the border between portions of first interior surface 184, indicated as lines 202 and 204, such portions corresponding the head 168 and legs 174. First interior surface 184 may be bounded by intersection line 182, fold line 200, and outer edges 162. Second interior surface 186 may be bounded by intersection line 182, fold line 194, and outer edges 150 and 152. Third interior surface 188 may be bounded by intersection line 182, fold lines 194 and 196 and outer edge 154. Fourth interior surface 190 may be bounded by intersection line 182, fold lines 196 and 198 and outer edge 156. Finally, fifth interior surface 192 may be bounded by fold lines 198 and 200 and outer edges 158 and 160. Interior selected edges 142, 144, 146, and 148 of object 140 may be attached such that second and third interior surfaces 186 and 188, third and fourth interior surfaces 188 and 190, and fourth and fifth interior surfaces 190 and 192 are disposed at an angle of at least about 25 degrees with respect to each other, and at an angle of at least about 60 degrees with respect to first interior surface 184. The five interior surfaces may be provided with different colors, for example, green on surfaces 186 and 188, yellow on surfaces 190 and 192, and portion of yellow and green on surface 184.

In the present embodiment, all outer edges are contoured. Second and third interior surfaces 186 and 188, third and fourth interior surfaces 188 and 190, and fourth and fifth interior surfaces 190 and 192 are disposed at an angle of about 60 degrees with respect to each other, and at an angle of about 90 degrees with respect to first interior surface 184.

Figure 3:
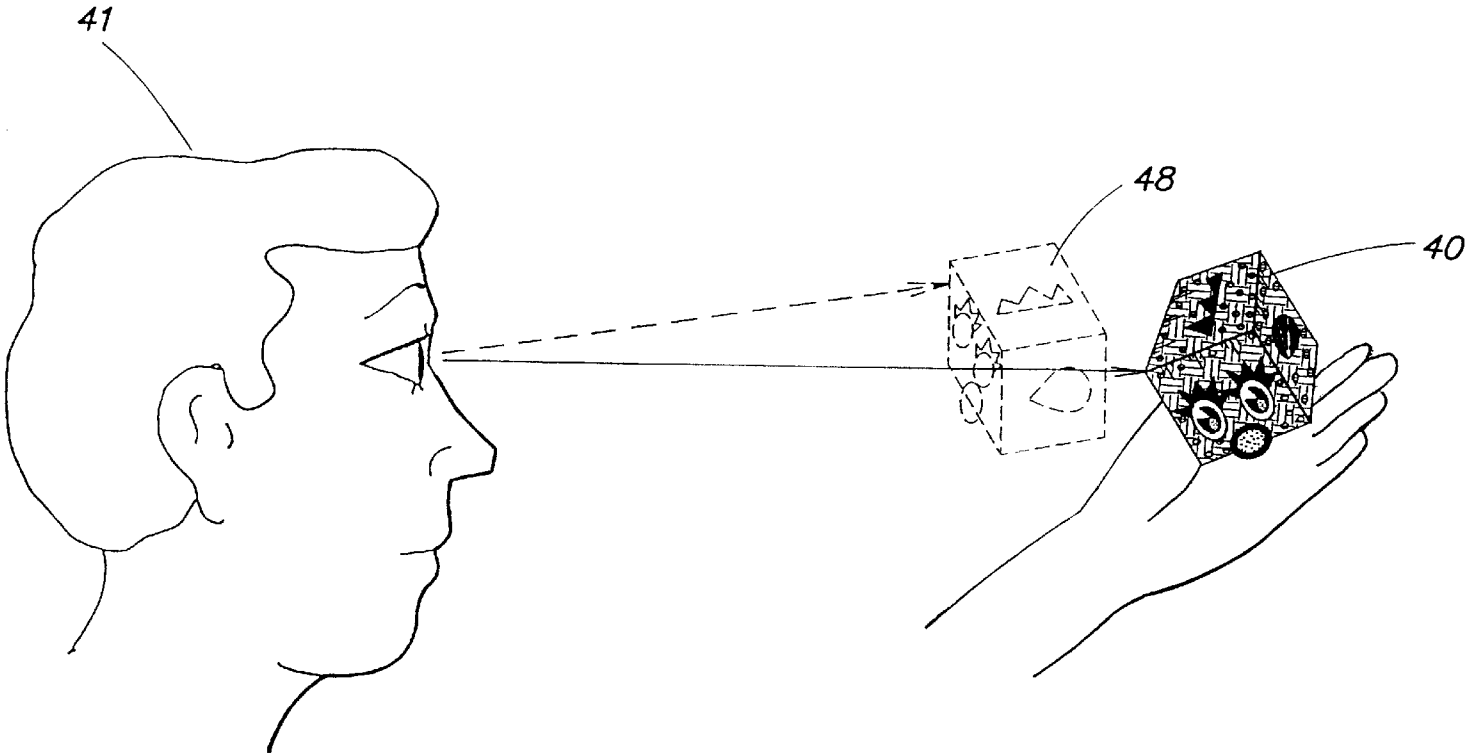
FIG. 3 illustrates the inverted appearance of the object of FIG. 1 as it appears to a viewer with one eye closed.

A method of viewing the three-dimensional objects is illustrated in FIG. 3, which shows an inverted image 48 of three-dimensional object 40 as it appears to a viewer 41 having or using only one eye. Although illustrated using the image invertible object 40 shown in FIG. 1, the method is useful for any object made in accordance with the present invention. According to the method, object 40 is placed at a distance from viewer 41 such that when viewer 41 observes object 40 using two eyes, it appears to be a three-dimensional object having three patterned interior surfaces, with pattern 30 and animating features 32, 34, 36 and 38 formed thereon. When viewer 41 subsequently observes object 40 with only one eye, the object 40 appears inverted, that is, the three interior surfaces now appear to be exterior surfaces, with pattern 30 and features 32, 34, 36 and 38 formed thereon. As noted previously, such object inversion is enhanced when the interior surfaces include various colors, color shades, patterns and features, including animating features, formed thereon. Additionally, or alternatively, such object inversion is further enhanced by providing indicia along intersecting and/or fold lines, or portions thereof, by providing indicia between features, varying the angles between the surfaces, or any combination thereof. Finally, contoured edges preferably include various protrusions therefrom when needed to impart realism to such objects.

As stated previously, the image invertible objects of the present invention may further include another optical illusion such MAGIC-EYE™ stereograms or MAGIC-EYE FLOATER™ autostereograms. Such optical illusions may be printed directly on to at least one of the surfaces of the image invertible objects, and may require, in some instances, the application of a second material, preferably opaque or transparent, over the at least a portion of a sheet. Such material may include, but is not limited to, lenticular sheets, light reflecting material, light absorbing materials, or any combination thereof.

Although not illustrated in detail, the method illustrated in FIG. 3 can also involve imparting movement to the objects in order to provide the appearance of animation. For example, a viewer supporting such an object with their hand can impart movement to the objects simply by moving their fingers or by moving their hand through space. Alternatively, a viewer can move in relation to an object supported on a stationary surface such as a table. Although illustrated with reference to the surface of a hand or table, it will be understood that any surface that will support such image invertible objects can be used in the method, for example, the object may be supported by a pencil or the like, as shown in FIG. 8.

Another embodiment of the method previously described includes connecting two image invertible objects as shown in FIG. 6, preferably loosely, using, for example tape extending from a surface opposing surface 196. One of ordinary skill will recognize that such objects may be connected in any manner, on any surface, in order to provide the desired effect of relative movement. When two or more of the image invertible objects are connected to each other, and movement is imparted as previously described, the animation effect is particularly pronounced, as the objects appear to move in relation to each other. The appearance of movement is particularly effective when the object is one which the brain would normally expect to move, such as an animal, or a car.

It will be understood that various modifications may be made to the embodiments disclosed herein. For example, although the embodiments disclosed herein are with reference to animating features, they are not necessary to the image invertible objects, and inanimate features may also be used. Alternatively, the patterns formed on the interior surfaces may be highly geometric rather than circular or oval shaped. In addition, such image invertible objects are not limited to two or four selected edges, or three or five interior surfaces, and can include an unlimited number thereof. Finally, any number of image invertible objects can be connected together in order to provide the appearance of relative movement. Therefore, the above description should not be construed as limiting, but merely as exemplifications of preferred embodiments. Those skilled in the art will envision other modifications within the scope and spirit of the claims appended hereto.

What is claimed is:

1. A three-dimensional object appearing inverted when viewed at a selected angle, the three-dimensional object comprising:

at least one sheet having a surface and at least three edges, at least two of the edges attached at an angle of greater than about 25 degrees;

a two-dimensional pattern formed on the surface;

at least one protrusion extending from an outer edge of the at least one sheet; and the at least two attached edges being joined such that a composite, three-dimensional object having at least three interior surfaces is formed from the at least one sheet, said three-dimensional object being concave yet appearing convex when viewed at the selected angle.

2. The object as in claim 1, further comprising an indicium extending along at least a portion of an intersection of the at least three interior surfaces, the indicium being visually distinct from the two-dimensional pattern.

3. The object as in claim 1, wherein the at least one sheet is foam board.

4. The object as in claim 1, wherein the at least two attached edges are at an angle of greater than about 45 degrees.

5. The object as in claim 1, further comprising at least a second three-dimensional object connected thereto.

6. The object as in claim 1, wherein the pattern and the at least three interior surfaces comprise a plurality of colors.

7. The object as in claim 6, wherein the pattern and the at least three interior surfaces comprise a plurality of highly contrasting colors.

8. The object of claim 7 wherein the at least one protrusion comprises a color that is visually distinct from the color of the interior surfaces.

9. The object as in claim 1 wherein the at least three surfaces comprise the same color.

10. The object as in claim 9 wherein at least one of the at least three surfaces comprises a different shade of the same color.

11. A method of creating an inverted image of a three-dimensional object, the method comprising:

providing at least one sheet having a first surface, at least one protrusion extending from an outer edge, and at least two selected edges;

forming a patterned two-dimensional image on the first surface;

forming a first composite three-dimensional object from the at least one sheet by attaching at least two of the selected edges at an angle of greater than about 25 degrees such that the composite comprises at least three interior surfaces and an outer edge having at least one extending protrusion, said three-dimensional object being concave; and holding and moving the composite three-dimensional object in a line of sight of a single eye of a human subject at an angular disposition such that the three-dimensional image of the object is aligned in a perspective view along the line of sight of the single eye such that said concave object appears convex.

12. The method as in claim 11, further comprising:

placing an indicium along at least a portion of an intersection of the at least three interior surfaces; and selecting a color and light reflective intensity for the indicia placed along the intersection which is visually distinct from the two-dimensional pattern formed on the first surface.

13. The method as in claim 11, wherein the at least one sheet is foam board.

14. The method as in claim 11, comprising attaching the at least two selected edges at an angle of greater than about 45 degrees.

15. The method as in claim 11, further comprising forming at least a second three-dimensional object and connecting the at least second three-dimensional object to the first three-dimensional object.

16. The method as in claim 11, further comprising forming the three-dimensional object in the shape of an animal.

17. The method as in claim 15, further comprising forming the first and the at least second three-dimensional object in the shape of an animal.

18. The method as in claim 11, further comprising providing the two-dimensional pattern with animating features.

19. The method as in claim 14, further comprising providing the two-dimensional pattern with animating features.

20. A three-dimensional object appearing inverted when viewed at a selected angle and moved slightly within the plane of vision of a single eye of a human subject, the three-dimensional object comprising:

a plurality of sheets each having a surface and at least one selected edge;

at least one of the surfaces having formed thereon a two-dimensional pattern;

at least one protrusion extending from an outer edge of at least one of the sheets; and at least one selected edge of each sheet being attached at an angle of at least about 25 degrees such that a composite, three-dimensional object having a contoured outer edge and at least three interior surfaces is formed from the at least one sheet, said three-dimensional object being concave yet appearing convex when viewed at the selected angle.

21. The object of claim 20, wherein the at least one sheet is planar foam board.

22. The object of claim 1, further comprising a base for supporting the object.

23. The object of claim 1, further comprising a base for supporting the object.

* * * * *